United States Patent [19]

Wickberg

[11] Patent Number: 4,863,315

[45] Date of Patent: Sep. 5, 1989

[54] RETAINING WALL MEMBER

[76] Inventor: Norman E. Wickberg, 27 Wardell Cir., Oceanport, N.J. 07757

[21] Appl. No.: 268,031

[22] Filed: Nov. 7, 1988

[51] Int. Cl.[4] ..... E02D 5/00

[52] U.S. Cl. ..... 405/278; 405/274; 405/281

[58] Field of Search ..... 405/278, 279, 280, 281, 405/276, 277

[56] References Cited

U.S. PATENT DOCUMENTS 1,690,499 11/1928 Nolte ..... 405/279
1,790,438 1/1931 Nolte ..... 405/279
2,002,521 5/1935 Borberg ..... 405/278
3,333,431 8/1967 Dougherty ..... 405/278

FOREIGN PATENT DOCUMENTS 443556 5/1927 Fed. Rep. of Germany ..... 405/278

*Primary Examiner*—Dennis L. Taylor
*Attorney, Agent, or Firm*—Charles Lee Thomason

[57] ABSTRACT

A polymeric retaining wall member with interlocking means along its edges that are universally mateable to like members, such that a plurality of like members can be interlocked to form a wall.

1 Claim, 2 Drawing Sheets

RETAINING WALL MEMBER

FIELD OF THE INVENTION

The present invention relates to bulkheads and wall forming members.

BACKGROUND OF THE INVENTION

In the field of retaining walls, various combinations of planks, crossbars and anchors have longed been used. To retain embankments or property along a waterfront, bulkhead walls of steel or timber were used commonly. Such materials are disfavored now for many reasons, and so, a need exists for an improved retaining wall member.

Timber and steel bulkheads are costly, and there is a concern about the continued availability of those materials. Also, heavy equipment and skilled workers are needed to install steel or timber wall members. These materials corrode and decay.

Timber can be treated to delay rot. However, known wood treatments involve chemicals that environmental and labor agencies presently regulate and even prohibit. Steel, even coated steel, will corrode in marine use. For example, equipment aboard ships leak electrical charges that are conducted through ions in the water to the grounded steel members. This cathodic reaction hastens the deterioration of steel. To avoid these problems, polymeric material can be fabricated into retaining wall members. When using polymeric planks or members, their structure dictates their strength and loading capacity.

SUMMARY OF THE INVENTION

In the present investion, the wall members generally are long and narrow. To provide additional strength and avoid deformation under loading conditions, the present invention has the following-described structure. It is a long and narrow triplanar member. In cross-section, it resembles a baseless trapezoid. It has a center section, that would correspond to the top of the trapezoid. Extending from the center section of the member are a pair of side walls. The trapezoidal shape increases strength and decreases deformation and bending in the vertical. To form a wall, a plurality of the members are aligned in generally parallel fashion. The members have along their edges means to connect them to the like members. An interlock structure is molded along the outward edge of each of the side walls. It connects and interlocks the polymeric planks in a simple yet near permanent way.

In the present invention, the interlocking means is a combination receiving channel and flanges. The side wall edge portions of the member extend radially into a pair of opposing edges that define a groove or receiving channel. In cross-section the groove can be generally tubular, semi-cylindrical or U-shaped. These arc-shaped edges terminate into flanges that are spatially disjunct. In cross-section, there appears two flanges. An L-shaped flange edge that protrudes toward the opposite flange edge, which is T-shaped. The base of the L flange and the top of the T flange have a common center line. This center line is in perpindicular relation to the center section of the retaining wall member.

The receiving channel will accept flanges of like members. The flanges slide into the receiving channel. They are retained within the channel due to the dimensions of the flanges, the channel, and the distance between the opposing flanges. The edges thus interlock and the members are held edgewise in association. The receiving channel along the longitudinal edge of a member will accept a single L-shaped edge of a second like member. Alternatively, the channel can engage a single T-shaped edge of a second member. Or, the channel will engage with both an L-shaped edge of a second member, and a T-shaped edge of a third member. Or, the channel will accept and engage two T-shaped edges or two L-shaped edges. A preferred material for use in forming the wall members in the present invention is PVC plastic, and also, PVC reinforced with fiberglass or other fiber material. An extrusion process can be used to form the members.

PRIOR ART

To address the need for a resilient cost-effective means for sea wall and bulkhead construction, the prior art discloses wall members of timber, steel and concrete. In addition, a polymeric member was disclosed in U.S. Patent Nos. 4,674,921 and 4,690,588 to Berger. However, those patents disclose a member using only a tongue and groove edge means of interlocking, and those members are transversely convex.

DESCRIPTION OF THE PREFERRED EMBODIMENTS

Figures 1, 2:
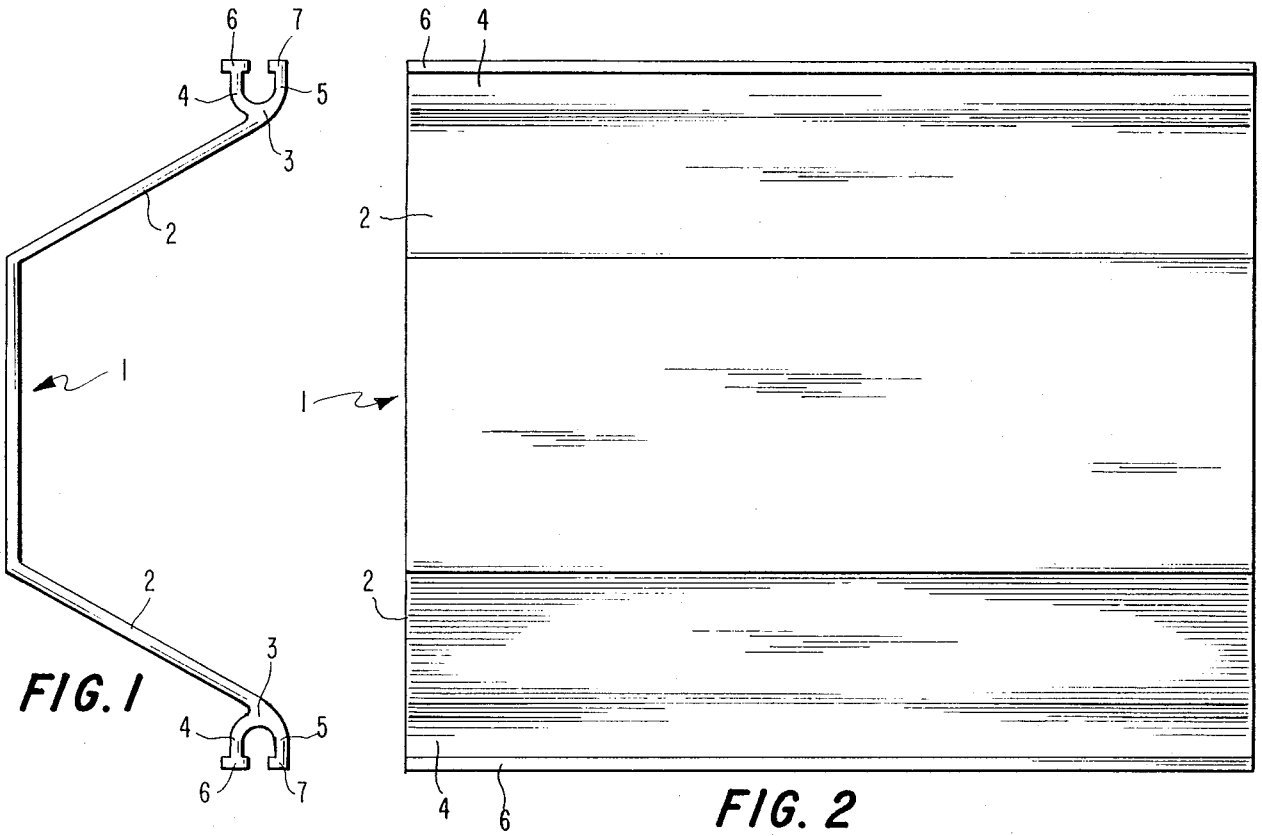
FIG. 1 is a sectional view of the wall retaining member.
FIG. 2 is a front view of the present invention as shown in FIG. 1.
Figure 3:
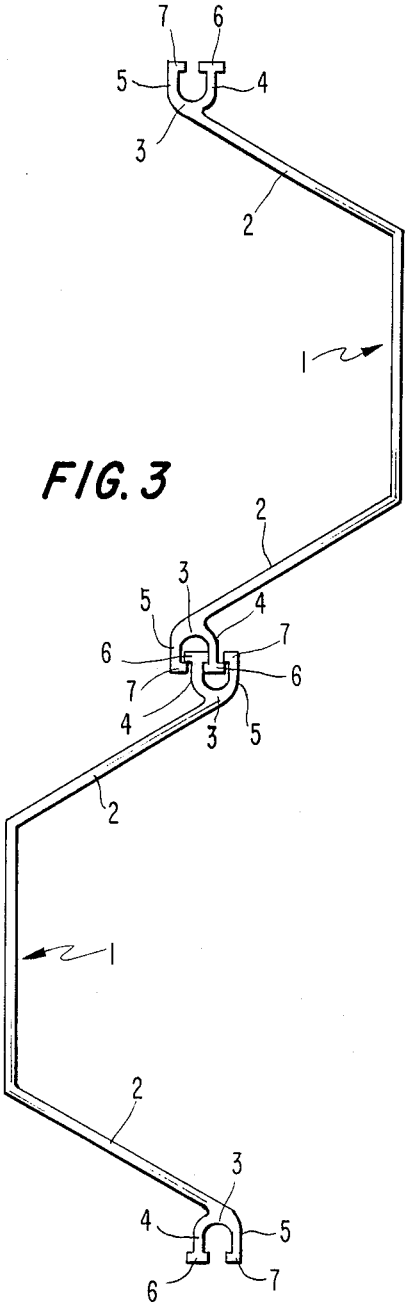
FIG. 3 is a sectional view of two wall members interlocked in obverse parallel relation.
Figure 4:
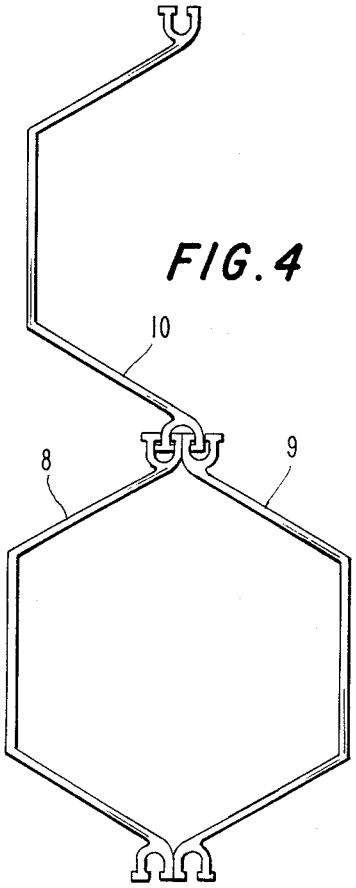
FIG. 4. is a second embodiment of the present invention in which three wall members are interlocked.

The invention, as depicted in a sectional view FIG. 1, is a baseless trapezoid. The wall member has three planar surfaces, a center section 1 and a pair of outer sections or side walls 2. The center section 1 is rectangular and is connected integrally to the outer sections 2. FIG. 2. Each side wall 2 is rectangular and extends from the center section 1 at included obtuse angles. FIG. 1. Along the outer edge of each side wall 2 are flange edges 6 and 7 that define a groove 3. The side wall 2 divides into an upper edge 4 and a lower edge 5. These edges 4 and 5 extend radially to define a semicircular groove or receiving channel 3. In sectional view, the groove 3 is generally annular. The upper edge 4 terminates in flange edge 6, which in sectional view is T-shaped. The lower edge 5 terminates in flange edge 7, which in sectional view is L-shaped. The flange edges 6 and 7 are spatially displaced and in vertical alignment. The space between flange edge 6 and flange edge 7 is slightly greater than the thickness of the wall member, especially that of upper edge 4 and lower edge 5. The flange edges 6 and 7 share a common vertical center line, that is, the top of the T and the base of the L of flange edges 6 and 7 respectively. Also, this center line of the T and the L is in perpindicular relation to the center section of the wall member. The combination of the upper 4 and a lower arc edge 5, T-shape 6 and L-shape flange edge 7 together define a groove or furrow that comprises a receiving and interlocking means. Using this means, the retaining wall members are universally mateable one to another. A plurality of the members can be joined edgewise in association to form a retaining wall. One member is joined in repeating parallel alignment to a second member. The T-shape flange edge 6 of the first member is slid into the groove of the second member, and that places the L-shape flange edge 7 within the groove of the first member. Or, a wall can be made of members in an alternate parallel and obverse pattern. FIG. 3. The T-shape flange edge 6 of each member is placed within the groove of the other member. Or, a single member 10 can be mated to two members, one in parallel 8 and the second 9 in obverse relation to the single member. FIG. 4. The L-shape flange edges 7 of the two members 8 and 9 form a T that is fit within the groove of the single member 10. The flange edges of the single member 10 are slid within the grooves of members 8 and 9. The cavity between the two members 8 and 9 can accommodate a conventional piling or reinforced concrete, which will increase the loading capacity of the wall. The various patterns can be repeated or combined to achieve a page of applications and strengths. The members are aligned like planks to form a wall.

The invention disclosed herein has been described in detail with particular reference to the embodiments illustrated herein, it will be further understood by those skilled in the art that many variations and modifications can be made without departing from the spirit and scope of the invention described above and claimed as follows.

I claim:

1. A polymeric member that interlocks to form a retaining wall comprising an elongated member formed of three planar sections, one center section and two outer sections that extend outward from said center section at included obtuse angles with said center section, and having a pair of engaging grooves, one said groove along the lateral edge of each said outer section, each said groove being formed of opposing edges, an L-shaped edge opposing a T-shaped edge to define said groove semicircularly; said member in combination with a second said member aligned in parallel relation to said first member and with a third said member in obverse parallel relation to said first member; said third member interlocked longitudinally with said first and said second member by said L-shaped edge of said third member being clasped within said groove of said second member and said T-shaped edge of said second member being clasped with said groove of said first member.

* * * * *